US005578408A

United States Patent [19]

Kohtaki et al.

[11] Patent Number: 5,578,408

[45] Date of Patent: Nov. 26, 1996

[54] TONER FOR DEVELOPING ELECTROSTATIC IMAGE

[75] Inventors: Takaaki Kohtaki, Yokohama; Masaaki Taya, Kawasaki; Makoto Unno, Tokyo; Tadashi Doujo, Kawasaki, all of Japan

[73] Assignee: Canon Kabushiki Kaisha, Tokyo, Japan

[21] Appl. No.: 365,735

[22] Filed: Dec. 29, 1994

[30] Foreign Application Priority Data

Dec. 29, 1993 [JP] Japan ..... 5-354163

[51] Int. Cl.[6] ..... G03G 9/083; G03G 9/087

[52] U.S. Cl. ..... 430/106.6; 430/109; 430/110; 430/111

[58] Field of Search ..... 430/111, 109, 430/106.6, 110, 108

[56] References Cited

U.S. PATENT DOCUMENTS

| | | | |
|---|---|---|---|
| 2,297,691 | 10/1942 | Carlson | 430/55 |
| 3,666,363 | 5/1972 | Tanaka et al. | 430/55 |
| 4,071,361 | 1/1978 | Marushima | 430/54 |
| 5,110,704 | 5/1992 | Inoue et al. | 430/109 |
| 5,180,649 | 1/1993 | Kukimoto et al. | 430/106.6 |
| 5,234,784 | 8/1993 | Aslam et al. | 430/111 |
| 5,258,256 | 11/1993 | Aslam et al. | 430/111 |
| 5,330,871 | 7/1994 | Tanikawa et al. | 430/111 |
| 5,384,224 | 1/1995 | Tanikawa et al. | 431/110 |

FOREIGN PATENT DOCUMENTS

| | | | |
|---|---|---|---|
| 0516153 | 12/1992 | European Pat. Off. | 430/111 |
| 3-41471 | 2/1991 | Japan . | |
| 3-64766 | 3/1991 | Japan . | |
| 3-188468 | 8/1991 | Japan . | |
| 3-219262 | 9/1991 | Japan . | |
| 3-271757 | 12/1991 | Japan . | |

*Primary Examiner*—Lee C. Wright
*Attorney, Agent, or Firm*—Fitzpatrick, Cella, Harper & Scinto

[57] ABSTRACT

A toner for developing an electrostatic image is constituted by a binder resin and a colorant. The toner is characterized by a percentage change $_{G'}$ of at most 50% as calculated by the following formula (1):

$$\gamma_{G'}=(1-G'_{50\%}/G'_{1\%})\times 100 \quad (1),$$

wherein $\gamma_{G'}$ denotes a percentage change of storage modulus, $G'_{50\%}$ denotes a storage modulus at 50% strain at 150° C., and $G'_{1\%}$ denotes a storage modulus at 1% strain at 150° C.; a percentage change $\gamma_{G''}$ of at most 50% as calculated by the following formula (2):

$$\gamma_{G''}=(1-G''_{50\%}/G''_{1\%})\times 100 \quad (2),$$

wherein $\gamma_{G''}$ denotes a percentage change of loss modulus, $G''_{50\%}$ denotes a loss modulus at 50% strain, and $G''_{1\%}$ denotes a loss modulus at 1% strain; and a storage modulus G' of $3\times10^3$–$7\times10^4$ dyn/cm$^2$ in a range of 1–50% strain at 150° C. The toner is characterized by applicability to a wide variety of image forming apparatus, especially those having remarkably different fixing speeds.

27 Claims, 1 Drawing Sheet

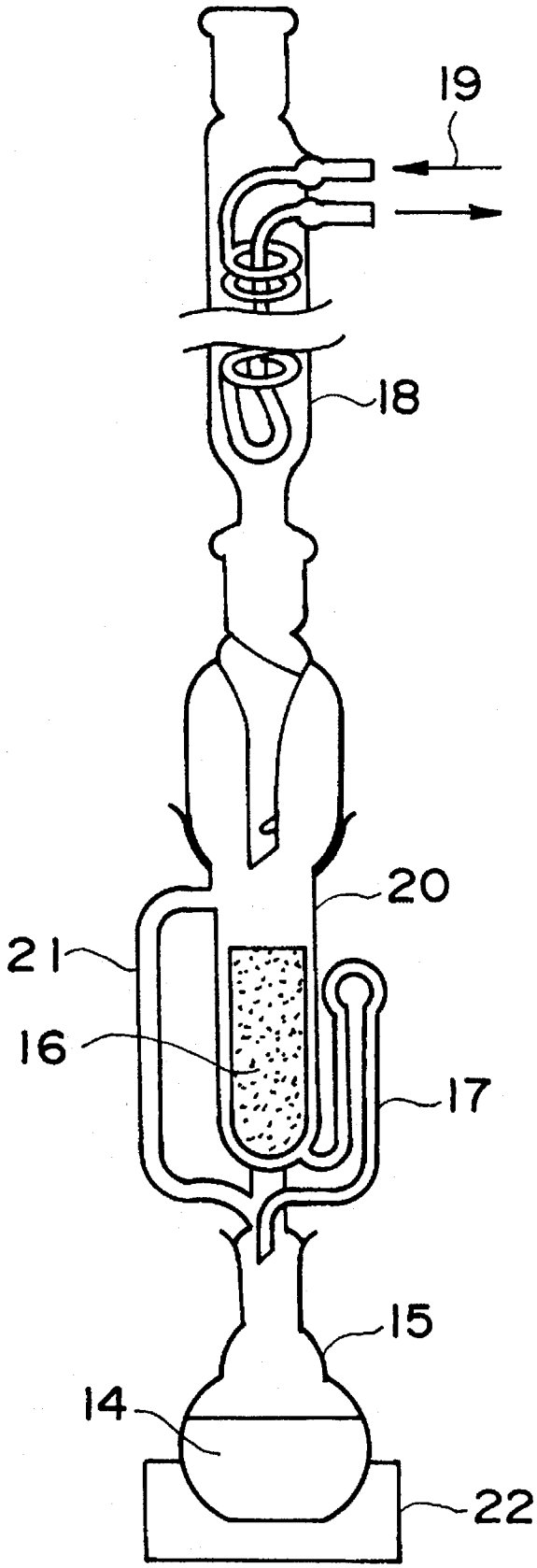
19
18
20
21
16
17
15
14
22

TONER FOR DEVELOPING ELECTROSTATIC IMAGE

FIELD OF THE INVENTION AND RELATED ART

The present invention relates to a toner for developing electrostatic images used in image forming methods, such as electrophotography, electrostatic recording or electrostatic printing, particularly a toner suitable for hot roller fixation.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy or print carrying a fixed toner image.

As for the step of fixing the toner image onto a sheet material such as paper which is the final step in the above process, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

Currently, different toners are used for different models of copying machines and printers. This is primarily because the different models adopt different fixing speeds and fixing temperatures. More specifically, in the fixing step, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon and is especially affected by the fixing speed and temperature. Generally, the fixing roller surface temperature is set to be low in case of a slow fixing speed and set to be high in case of a fast fixing speed. This is because a constant heat quantity is supplied to the toner image for fixation thereof regardless of a difference in fixing speed.

However, the toner on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause an offset phenomenon in case of a high heating roller temperature, while a low-temperature offset is liable to occur because of insufficient melting of the lowermost toner layer in case of a low heating roller temperature.

In order to solve the above problem, it has been found useful to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to arise several difficulties, such as a winding offset wherein the fixation sheet winds about the fixing roller, the appearance of a trace in the fixed image of a separating member for separating the fixation sheet from the fixing roller, and inferior copied images, such as resolution failure of line images and toner scattering, due to a high pressure.

Accordingly, in a high-speed fixing system, a toner having a lower melt viscosity is generally used than in the case of low speed fixation, so as to lower the heating roller temperature and fixing pressure, thereby effecting the fixation while obviating the high-temperature offset and winding offset. However, when using such a toner having a low melt viscosity in low speed fixation, an offset phenomenon is liable to be caused because of the low viscosity.

Accordingly, there has been desired a toner which shows a wide fixable temperature range and an excellent anti-offset characteristic and is applicable in the range from a low speed apparatus to a high speed apparatus.

On the other hand, in recent years, there have been also desired high-quality copy or print images in accordance with the use of digitalized copying machines and fine toner particles.

More specifically, it has been desired to obtain a photographic image accompanied with characters, so that the character images are clear while the photographic image is excellent in density gradation faithful to the original. Generally, in a copy of a photographic image accompanied by characters, if the line density is increased so as to provide clear character images, not only the density gradation characteristic of the photograph image is impaired, but also the halftone part thereof is roughened.

Further, resolution failure (collapsing) of line images and scattering are liable to be caused at the time of fixation as described above, so that the image qualities of the resultant copy images are rather liable to be deteriorated.

Further, in case where the line image density is increased, because of an increased toner coverage, a thick toner image is pushed against a photosensitive member to be attached to the photosensitive member in the toner transfer step, so that a so-called transfer failure (or a hollow image), i.e., a partial lack toner image (line images in this case), in the transferred image, is liable to be caused, thereby providing poor quality of copy images. On the other hand, in the case where the gradation characteristic of a photographic image is intended to be improved, the density of characters or line images are liable to be lowered, thus providing unclear images.

The use of a smaller particle size toner can increase the resolution and clearness of an image but is also liable to be accompanied by various difficulties.

First, a smaller particle size toner is liable to impair the fixability of a halftone image. This is particularly noticeable in high-speed fixation. This is because the toner coverage in a halftone part is small and a portion of toner transferred to a concavity of a fixation sheet receives only a small quantity of heat and the pressure applied thereto is also suppressed because of the convexity of the fixation sheet. A portion of toner transferred onto the convexity of the fixation sheet in a halftone part receives a much larger shearing force per toner particle because of a small toner layer thickness compared with that in a solid image part, thus being liable to cause offset or result in copy images of a lower image quality.

Fog is another problem. If the toner particle size is reduced, the surface area of a unit weight of toner is increased, so that the charge distribution thereof is liable to be broadened to cause fog. As the toner surface area is increased per unit weight thereof, the toner chargeability is liable to be affected by a change in environmental conditions.

If the toner particle size is reduced, the dispersion state of a polar material and a colorant is liable to affect the toner chargeability.

When such a small particle size toner is applied to a high-speed copying machine, the toner is liable to be excessively charged to cause fog and a density decrease, particularly in a low-humidity environment.

Further, in connection with a trend of providing a copying machine with a multiplicity of functions, such as a superposed multi-color copying by erasing a part of an image as by exposure and inserting another image into the erased part, or frame erasure by erasing a frame part on a copying sheet, fog of a small particle size is liable to remain in such a part which is erased into white.

When an image is erased by providing a potential of a polarity opposite to that of a latent image potential with respect to a development reference potential as by irradiation with intense light from LED, a fuse lamp, etc., the erased part is liable to cause fog.

Japanese Laid-Open Patent Application (JP-A) 3-219262 (Corresponding to U.S. Pat. No. 5,180,649) JP-A 3-64766 and JP-A 3-271757 have disclosed a toner having a storage modulus and a loss modulus in certain ranges, respectively. Such a toner may have excellent fixability and anti-offset characteristic under a certain fixing condition but it is not easy to satisfy fixability and anti-offset characteristic for various models of fixing devices having remarkably different fixing speeds, fixing pressures and shearing forces as described above and also to provide satisfactory image qualities.

JP-A 3-41471 and JP-A 3-188468 have proposed methods of using a binder resin obtained by severing the gel content of a polyester resin or a styrene-acrylic copolymer. According to these methods, however, the resultant toner is caused to have large percentage changes in storage modulus (G') and loss modulus (G") as defined hereinafter because of a short distance between crosslinking points in the polymer chain. Accordingly, the toner is liable to be inferior in fixability and image quality particularly at a halftone part.

SUMMARY OF THE INVENTION

A generic object of the present invention is to provide a toner for developing electrostatic images having solved the above-mentioned problems.

A more specific object of the present invention is to provide a toner for developing electrostatic images showing an excellent anti-offset characteristic without impairing the fixability from a low fixing speed to a high fixing speed.

Another object of the present invention is to provide a toner for developing electrostatic images, even in a small particle size, capable of showing a good fixability at a halftone part and providing copy images of good image quality.

Another object of the present invention is to provide a toner for developing electrostatic images capable of providing high-density copy images free from fog from a low to a high process speed.

Another object of the present invention is to provide a toner for developing electrostatic images capable of providing good images in a low-humidity environment and also in a high-humidity environment without being affected by a change in environmental conditions.

Another object of the present invention is to provide a toner for developing electrostatic images capable of providing good images even by a high-speed image-forming apparatus.

Another object of the present invention is to provide a toner for developing electrostatic images having excellent durability and capable of providing copy images having a high image density and free from fog even in a long period of continuous image formation.

Another object of the present invention is to provide copies of a photographic image with characters including clear character images and photographic images having a density gradation characteristic faithful to the original.

According to the present invention, there is provided a toner for developing an electrostatic image, comprising: a binder resin and a colorant; wherein the toner has a percentage change $\gamma_{G'}$ of at most 50% as calculated by the following formula (1):

$$\gamma_{G'}=(1-G'_{50\%}/G'_{1\%})\times 100 \quad (1),$$

wherein $\gamma_{G'}$ denotes a percentage change of storage modulus, $G'_{50\%}$ denotes a storage modulus at 50% strain at 150° C., and $G'_{1\%}$ denotes a storage modulus at 1% strain at 150° C., a percentage change $\gamma_{G''}$ of at most 50% as calculated by the following formula (2):

$$\gamma_{G''}=(1-G''_{50\%}/G''_{1\%})\times 100 \quad (2),$$

wherein $\gamma_{G''}$ denotes a percentage change of loss modulus, $G''_{50\%}$ denotes a loss modulus at 50% strain, and $G''_{1\%}$ denotes a loss modulus at 1% strain, and a storage modulus G' of $3\times10^3$–$7\times10^4$ dyn/cm$^2$ in a range of 1–50% strain at 150° C.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole figure in the drawing is an illustration of a Soxhlet extractor.

DETAILED DESCRIPTION OF THE INVENTION

According to our detailed study, excellent fixability and anti-offset characteristic are attained under varying fixing conditions by using a toner having low percentage changes of storage modulus G' and loss modulus G" corresponding to changes in strain.

The storage modulus G' and loss modulus G" are physical properties related with the anti-offset characteristic and fixability of a toner. A smaller storage modulus G' is liable to result in a lower anti-offset characteristic, and a larger loss modulus G" is liable to result in an inferior fixability.

In a high-speed fixation, a higher shearing force is exerted than in a low-speed fixation. Accordingly, the toner according to the present invention having low strain-dependent percentage changes of storage modulus G' and loss modulus G" can show excellent anti-offset characteristic without impairing the fixability for a low-speed to a high speed image forming apparatus.

The toner according to the invention has a storage modulus G' in the range of $3\times10^3$–$7\times10^4$ dyn/cm$^2$ in the range of 1–50% strain at 150° C. If the storage modulus G' is smaller than $3\times10^3$ dyn/cm$^2$, a high-temperature offset is liable to occur and, if the storage modulus G' is larger than $7\times10^4$ dyn/cm$^2$, the fixability is liable to be lowered. Particularly, in the case of a heat-pressure fixing device using a high fixing pressure, if the storage modulus G' is below $3\times10^3$ dyn/cm, the high-temperature offset is liable to occur because of insufficient elasticity.

It is further preferred that the toner has a percentage change $\gamma_{G'}$ of 0.1–35%, and a percentage change $\gamma_{G''}$ of 0.1–35%.

It is also preferred that the toner has a loss modulus G" in the range of $2\times10^3$–$6\times10^4$ dyn/cm$^2$ in the range of 1–50% strain at 150° C. If the loss-modulus G" is below $2\times10^3$ dyn/cm$^2$, a high temperature offset is liable to be caused and, if the loss modulus G" is above $6\times10^4$ dyn/cm$^2$, the fixability is liable to be lowered.

Particularly, in the case of using a high fixing speed and a hot roller having a small diameter giving a large curvature radius of the hot roller at the time of discharging paper after the fixation, the satisfaction of the above-mentioned range of the loss modulus G" is effective for offset prevention.

The binder resin used in the present invention may comprise a polyester resin, a vinyl resin or an epoxy resin. It is particularly preferred to use a polyester resin or a vinyl resin in view of the chargeability and the fixation characteristic.

In the case where the binder resin comprise a polyester resin, it is preferred that the toner has a storage modulus G' in the range of $4.5\times10^3$–$6.5\times10^4$ dyn/cm$^2$, and it is also preferred that the toner has a loss modulus G" in the range of $3\times10^3$–$5.5\times10^4$ dyn/cm$^2$.

The polyester resin preferably used in the present invention may have a composition as described below.

The polyester resin used in the present invention may preferably comprise 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

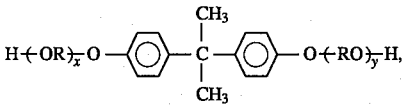

(A)

wherein R denotes an ethylene or propylene group, x and y are independently 0 or a positive integer with the proviso that the average of x+y is in the range of 0–10; diols represented by the following formula (B):

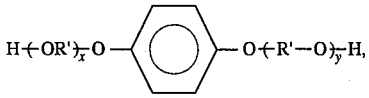

(B)

wherein R' denotes

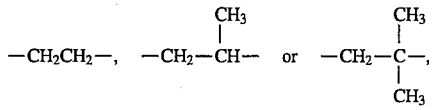

x' and y' are independently 0 or a positive integer with the proviso that the average of x'+y' is in the range of 0–10.

It is preferred that dibasic acid constitutes at least 50 mol. % of the total acid. Examples of the dibasic acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride.

The polyester resin used for producing the toner according to the present invention may preferably have a glass transition temperature (Tg) of 40°–90° C., particularly 45°–85° C., a number-average molecular weight (Mn) of 1,000–50,000, more preferably 1,500–20,000, and a weight-average molecular weight of $3\times10^3$–$1\times10^5$, more preferably $4\times10^4$–$9\times10^4$.

Examples of a vinyl monomer to be used for providing the vinyl resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of a carboxy group-containing monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid methacrylic acid, crotonic acid and cinnamic acid; α,β-unsaturated acid anhydrides, such as crotonic anhydride, and cinnamic anhydride; anhydrides between such an α,β-unsaturated acid and a lower aliphatic acid; alkenylmalonic acid alkenylglutaric acid alkenyladipic acid, and anhydrides and monoesters of these acids.

The binder resin comprising a vinyl resin may preferably have a glass transition point of 45°–80° C., preferably 55°–70° C., a number-average molecular weight (Mn) of $2.5\times10^3$–$5\times10^4$, and a weight-average molecular weight (Mw) of $1\times10^4$–$1.0\times10^6$.

In the present invention, it is also possible to add another type of resin, such as polyurethane, epoxy resin polyvinyl butyral, modified resin, terpene resin, phenolic resin, aliphatic or alicyclic hydrocarbon resin, or aromatic petroleum resin, as desired, to the binder resin.

In the case of using two or more species of resins in mixture to constitute a binder resin, it is preferred to preferred to mix resins having different molecular weights in appropriate proportions.

In order to provide the toner having percentage changes of at most 50% between strains of 1% and 50% of storage modulus G' and loss modulus G", the properties of a binder resin constituting the toner constitute an important factor. For this purpose, it is preferred to use a resin having a relatively low molecular weight, i.e., a number-average molecular weight of 1,000–50,000, preferably 2,000–20,000, and a gel resin having a long distance between crosslinking points in its polymer chain to provide a binder resin. When the resins having the above-mentioned properties as the binder resin are used to produce a toner, the gel resin may be subjected to severance, thereby providing a polymer component having a long branch chain to suitably providing small percentage changes.

In case where the polyester resin is used as a principal binder resin in a toner containing such a component formed by severance of the gel resin, the binder resin contained in the toner may preferably have a number-average molecular weight (Mn) of 1,000–50,000, more preferably 1,500–20,000, and a weight-average molecular weight (Mw) of $3\times10^3$–$2\times10^6$, more preferably $4\times10^4$–$1.5\times10^6$. Also in the case where the vinyl resin is used as a principal binder resin in a toner containing such a component formed by severance of the gel resin, the binder resin contained in the toner may preferably have a number-average molecular weight (Mn) of 2,500–50,000 and a weight-average molecular weight (Mw) of $1\times10^5$–$1\times10^6$.

This is presumably for the following reason.

In a case where two types of resins having an identical molecular weight but having different distances between crosslinking points in polymer chains are respectively subjected to severance to form polymer components, a resin having a longer distance between crosslinking points provides a polymer component having a longer branch length. Accordingly, the branch length is considered to have a large influence in interaction with a low-molecular weight resin when the polymer component is mixed with the low-molecular weight resin to provide a toner. Because of the presence of such a resin having a long branch, the entanglement thereof with a low-molecular weight resin is stronger than a resin having a short branch. As a result, a toner comprising such a resin mixture is caused to lower the percentage changes of storage modulus G' and loss modulus G" between those at 1% strain and 50% strain at 150° C. to be below 50%. When a toner is constituted by a mixture of a linear high-molecular weight resin or a resin having a structure close thereto and a linear low-molecular weight resin through the use of a high-molecular weight polymer having a short distance between crosslinking points, it is difficult to realize the percentage changes of at most 50%.

A polyester resin comprising a gel component having a long distance between crosslinking points may for example be produced in the following manner:

(1) A linear polyester or a polyester having a small gel content is first formed, and then an alcohol or acid having 3 or more functional groups is added to cause polycondensation.

(2) A polyester having a small gel content is formed by using an alcohol or acid having three or more functional groups through utilization of a difference in polycondensation activity, and a linear or nonlinear polyester and/or an alcohol or acid having thee or more functional groups is added thereto for further polycondensation.

A vinyl copolymer resin comprising a gel component having a long distance may for example be produced by using a crosslinking agent having a long distance between crosslinking functional groups, examples of which may include diacrylate or dimethacrylate compounds having an intermediate alkyl chain; diacrylate or dimethacrylate compounds having an intermediate alkyl chain including an ether bond; and diacrylate or dimethacrylate compounds having an intermediate chain including an aromatic group and an ether bond. Among these crosslinking agents, it is preferred to use a crosslinking agent having a molecular weight of at least 300 for accomplishing the object of the present invention.

Preferred examples thereof may include: tetraethylene glycol dimethacrylate, polyethylene glycol diacrylate, polyoxyethylene-(2)-3,3-bis(4-hydroxyphenyl)propane diacrylate, and polyoxyethylene (4)-2,2-bis(4-hydroxyphenyl)propane diacrylate.

It is also possible to use a crosslinking agent having a molecular weight of below 300 in combination with one having a molecular weight of at least 300 within an extent not adverse to the object of the present invention.

Alternatively, it is also possible to mix a vinyl copolymer having a carboxyl group and/or a hydroxyl group with a polyester resin for further condensation.

A resin composition comprising a mixture of a resin having a relatively low number-average molecular weight of 1,000–50,000 and a gel component resin having a long distance between crosslinking points may for example be prepared by (1) separately preparing such low-molecular weight resin and gel component resin and mixing them; and (2) preparing a polyester resin composition by adding a diamine or diisocyanate component, etc., having an effect of broadening the molecular weight distribution to (a) a system of synthesizing a linear polyester or (b) a system of synthesizing a gel-resin having a long distance between crosslinking points.

The gel component may be severed to provide a high-molecular weight component having a long branch during melt-kneading as by a twin-screw kneader, an extruder or a pressurized kneader.

In the toner for developing electrostatic images according to the present invention, it is preferred to add a charge control agent, as desired, in order to further stabilize the chargeability thereof. The charge control agent may be used in 0.1–10 wt. parts, preferably 0.1–5 wt. parts, per 100 wt. parts of the binder resin.

The charge control agent may for example be as follows.

Examples of negative charge control agents may include organometal complexes and chelate compounds, inclusive of mono-azo metal complexes, aromatic hydroxycarboxylic acid metal complexes and aromatic dicarboxylic acid metal complexes. Other examples may include: aromatic hydroxycarboxylic acids, aromatic mono- and poly-carboxylic acids, metal salts, anhydrides and esters of these acids, and phenol derivatives of bisphenols.

Examples of positive charge control agent for providing a positively chargeable toner may include: nigrosine, triphenylmethane compounds, rhodamine dyes, and polyvinylpyridine. A color toner may preferably be prepared by using a binder resin obtained by using an amino group-containing carboxylic acid ester, such as dimethylaminomethyl methacrylate, capable of providing a positive chargeability in an amount of 0.1–40 mol. %, preferably 1–30 mol. % of the monomer, or by using a colorless or pale-colored positive charge control agent not adversely affecting the toner hue. Examples of the positive charge control agent may include quaternary ammonium salts represented by the following formulae (A) and (B):

Formula (A)

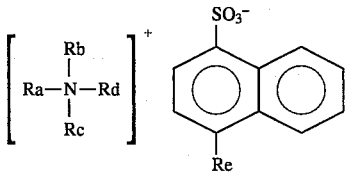

wherein Ra, Rb, Rc and Rd independently denote a $C_1$–$C_{10}$ alkyl group or a substituted phenyl group denoted by

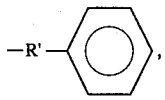

R' denoting a $C_1$–$C_5$ alkyl group and Re denotes —H, —OH, —COOH or a $C_1$–$C_5$ alkyl group.

Formula (B)

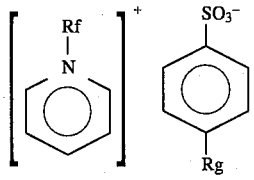

wherein Rf denotes $C_{1-5}$ alkyl group, and Rg denotes —H, —OH, —COOH or a $C_1$–$C_5$ alkyl group.

Among the quaternary ammonium salts represented by the above formulae (A) and (B), it is particularly preferred to use the compounds of the following formulae (A)-1, (A)-2 and (B)-1 as a positive charge control agent in order to provide a good chargeability little affected by an environmental change.

Formula (A)-1

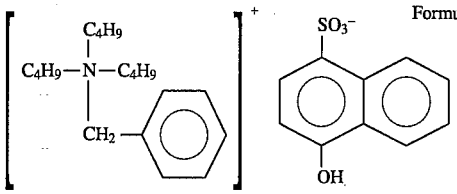

Formula (A)-2

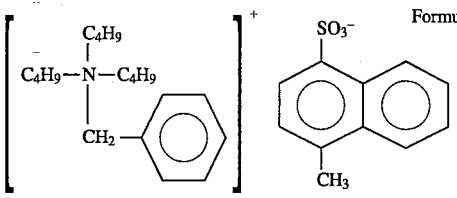

Formula (B-1)

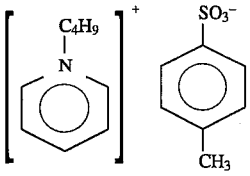

In the case of constituting a positively chargeable toner by using a polymer or copolymer of an amino group-containing ester, such as dimethyl aminomethyl methacrylate, showing a positive chargeability as a binder resin component, it is also possible to further add a positive charge control agent or a negative charge control agent, as desired.

In case of not using such a polymer showing a positive chargeability, it is preferred to add 0.1–15 wt. parts, more preferably 0.5–10 wt. parts, of a positive charge control agent per 100 wt. parts of the binder resin. In the case of using such a polymer or copolymer of an amino group-containing ester, it is preferred to add at most 10 wt. parts, preferably at most 8 wt. parts, of a positive charge control agent and/or a negative charge control agent, as desired, for the purpose of providing a good chargeability less affected by an environment condition.

When the toner according to the present invention is constituted as a magnetic toner, the magnetic toner may contain a magnetic material, examples of which may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size (Dav.) of 0.1–2 μm, preferably 0.1–0.3 μm. The magnetic material may preferably show magnetic properties when measured by application of 10 kilo-Oersted, inclusive of: a coercive force (Hc) of 20–150 Oersted, a saturation magnetization (σs) of 50–200 emu/g, particularly 50–100 emu/g, and a residual magnetization (πr) of 2–20 emu/g.

The magnetic material may be contained in the toner in a proportion of 65–200 wt. parts, preferably 70–150 wt. parts, per 100 wt. parts of the binder resin.

The toner according to the present invention may optionally contain a non-magnetic colorant, examples of which may include: carbon black, titanium white, and other pigments and/or dyes. For example, the toner according to the present invention, when used as a color toner, may contain a dye, examples of which may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6. Examples of the pigment may include: Chrome Yellow, Cadmium Yellow, Mineral Fast Yellow, Navel Yellow, Naphthol Yellow S, Hansa Yellow G, Permanent Yellow NCG, Tartrazine Lake, Orange Chrome Yellow, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B; Manganese Violet, Fast Violet B, Methyl Violet Lake, Ultramarine, Cobalt BLue, Alkali Blue Lake, Victoria Blue Lake, Phthalocyanine Blue, Fast Sky Blue, Indanthrene Blue BC, Chrome Green, chromium oxide, Pigment Green B, Malachite Green Lake, and Final Yellow Green G.

In case of constituting the toner according to the present invention as a toner for a two-component type full color developer, various colorants inclusive of the pigment and dye may be added.

Examples of a magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments represented by the following formula and having a phthalocyanine skeleton to which 1–5 phthalimidomethyl groups are added:

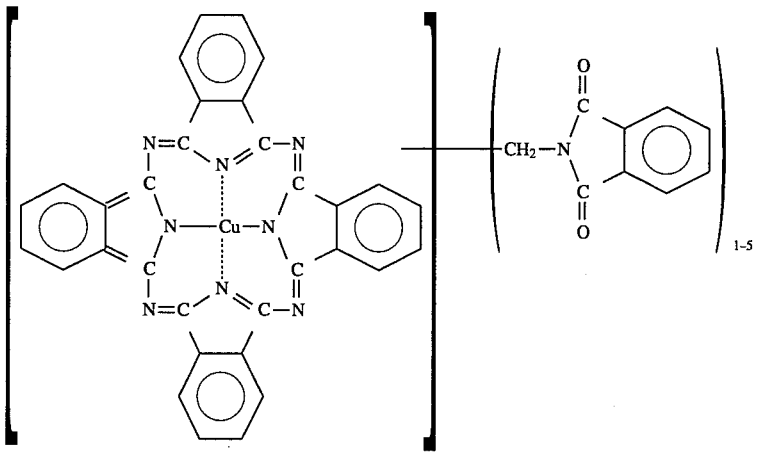

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 0.1–60 wt. parts, preferably 0.5–50 wt. parts, per 100 wt. parts of the binder resin.

In the present invention, it is also possible to incorporate one or two or more species of release agent, as desired within, toner particles.

Examples of such a release agent which is solid at room temperature may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, behenyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid partially esterified products between aliphatic acids and polyhydric alcohols, such as behenic acid monoglyceride;

and methyl ester compounds having hydroxyl group as obtained by hydrogenating vegetable fat and oil.

A particularly preferred class of release agent (wax) in the present invention may include aliphatic alcohol waxes and aliphatic hydrocarbon waxes. The aliphatic alcohol waxes may be represented by the following formula (C):

Formula (C): $CH_3(CH_2)_xCH_2OH(x=20–250)$.

Specific examples of the wax preferably used in the present invention may include e.g., a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; a hydrocarbon wax obtained by subjecting a mixture gas containing carbon monoxide and hydrogen to the Arge process to form a hydrocarbon mixture and distilling the hydrocarbon mixture to recover a residue; and hydrogenation products of the above. Fractionation of wax may preferably be performed by the press sweating method, the solvent method, vacuum distillation or fractionating crystallization to recover a fractionated wax. As the source of the hydrocarbon wax, it is preferred to use hydrocarbons having up to several hundred carbon atoms as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few branches. It is further preferred to use hydrocarbon waxes synthesized without polymerization because of their structure and molecular weight distribution suitable for easy fractionation.

As for the molecular weight distribution of the wax, it is preferred that the wax shows a peak in a molecular weight region of 400–2400, further 450–2000, particularly 500–1600. By satisfying such molecular weight distribution, the resultant toner is provided with preferable thermal characteristics.

The release agent, when used, may preferably be used in an amount of 0.1–20 wt. parts, particularly 0.5–10 wt. parts, per 100 wt. parts of the binder resin.

The release agent may be uniformly dispersed in the binder resin by a method of mixing the release agent in a solution of the resin at an elevated temperature under stirring or melt-kneading the binder resin together with the release agent.

The toner according to the present invention may preferably have a weight-average particle size of 3–10 μm, more preferably 3–9 μm, so as to provide high-quality images.

A flowability-improving agent may be blended with the toner to improve the flowability of the toner. Examples thereof, particularly negatively chargeable ones may include: powder of fluorine-containing resin, such as polyvinylidene fluoride fine powder and polytetrafluoroethylene fine powder; titanium oxide fine powder, hydrophobic titanium oxide fine powder; fine powdery silica such as wet-process silica and dry-process silica, and treated silica obtained by surface-treating (hydrophobizing) such fine powdery silica with silane coupling agent, titanium coupling agent, silicone oil, etc.; titanium oxide fine powder, hydrophobized titanium oxide fine powder; aluminum oxide fine powder, and hydrophobized aluminum oxide fine powder.

A preferred class of the flowability-improving agent includes dry process silica or fumed silica obtained by vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

It is also possible to use a flowability-improving agent as a positive chargeability prepared by treating the above-mentioned dry-process silica with an amino group-containing silane coupling agent or silicone oil as shown below:

$H_2NCH_2CH_2CH_2Si(OCH_3)_3$ $H_2NCH_2CH_2CH_2Si(OC_2H_5)_3$ $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$ $H_2NCH_2CH_2NHCH_2CH_2CH_2Si(OCH_3)_3$ $H_2NCH_2CH_2NHCH_2CH_2NHCH_2CH_2CH_2Si(OCH_3)_3$ $H_3C_2OCOCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NHCH_2CH_2CH_2Si(OCH_3)_3$ $H_3COCOCH_2CH_2NHCH_2CH_2NHCH_2CH_2CH_2Si(OCH_3)_3$ $(H_5C_2)_2N-CH_2CH_2CH_2Si(OCH_3)_3$

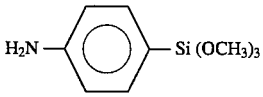

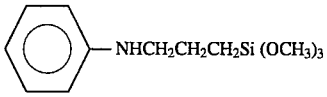

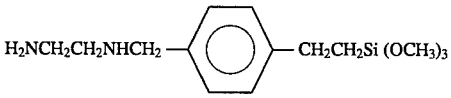

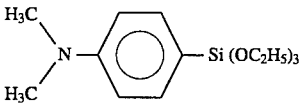

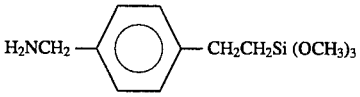

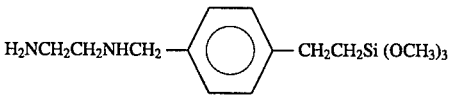

$(HOCH_2CH_2)_2N-CH_2CH_2CH_2Si(OCH_3)_3$ $(H_2CO)_3SiCH_2CH_2CH_2-NHCH_2$

-continued

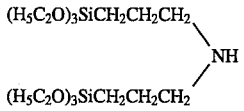

$H_2CNHCH_2CH_2CH_2Si\ (OC_2H_5)_3$ $H_2N\ (CH_2CH_2NH)_2CH_2CH_2CH_2Si\ (OCH_3)_3$ $H_3C-NHCONHC_3H_6Si\ (OCH_3)_3$

As a silicone oil, it is possible to use an amino-modified silicone oil having a partial structure including an amino group in its side chain as shown below:

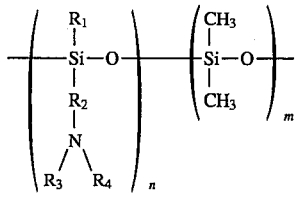

wherein $R_1$ denotes hydrogen, alkyl group, aryl group or alkoxy group; $R_2$ denotes alkylene group or phenylene group; $R_3$ and $R_4$ denote hydrogen, alkyl group or aryl group with the proviso that the alkyl group, aryl group, alkylene group and/or phenylene group can contain an amino group or another substituent, such as halogen, within an extent of not impairing the chargeability. m and n denote a positive integer.

Commercially available examples of the amino group-containing silicone oil may include the following:

| Trade name (Maker) | Viscosity at 25° C. (cPs) | Amine equivalent |
|---|---|---|
| SF8417 (Toray Silicone K.K.) | 1200 | 3500 |
| KF393 (Shin'Etsu Kagaku K.K.) | 60 | 360 |
| KF857 (Shin'Etsu Kagaku K.K.) | 70 | 830 |
| KF860 (Shin'Etsu Kagaku K.K.) | 250 | 7600 |
| KF861 (Shin'Etsu Kagaku K.K.) | 3500 | 2000 |
| KF862 (Shin'Etsu Kagaku K.K.) | 750 | 1900 |
| KF864 (Shin'Etsu Kagaku K.K.) | 1700 | 3800 |
| KF865 (Shin'Etsu Kagaku K.K.) | 90 | 4400 |
| KF369 (Shin'Etsu Kagaku K.K.) | 20 | 320 |
| KF383 (Shin'Etsu Kagaku K.K.) | 20 | 320 |
| X-22-3680 (Shin'Etsu Kagaku K.K.) | 90 | 8800 |
| X-22-380D (Shin'Etsu Kagaku K.K.) | 2300 | 3800 |
| X-22-380IC (Shin'Etsu Kagaku K.K.) | 3500 | 3800 |
| X-22-3819B (Shin'Etsu Kagaku K.K.) | 1300 | 1700 |

The amine equivalent refers to a g-equivalent per amine which is equal to a value of the molecular weight of an amino group-containing silicone oil by the number of amino groups in the silicone oil.

The flowability-improving agent may have a specific surface area of at least 30 $m^2/g$, preferably 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner.

The toner according to the present invention may be prepared by sufficiently blending the binder resin, a magnetic or non-magnetic colorant, and a charge control agent or other additives, as desired, by a blender such as a Henschel mixer or a ball mill, followed by melt-kneading for mutual dissolution of the resins of the blend, cooling for solidification of the kneaded product, pulverization and classification to recover a toner product.

The toner may be further sufficiently blended with an external additive such as a flowability-improving agent having a chargeability to a polarity identical to that of the toner by a blender such as a Henschel mixer to obtain a toner according to the present invention, wherein the external additive is carried on the surface of the toner particles.

Various parameters characterizing the toner according to the present invention are based on values measured in the following manner.

(1) Percentage changes $\gamma G'$ and $\gamma G''$ between strains of 1% and 50% of storage modulus G' and loss modulus G"

A toner is molded at room temperature under a pressure of 150 $kg/cm^2$ for 5 min. into a sample pellet of 25 mm in diameter and 2 mm in thickness.

The sample pellet is disposed between parallel plates of 25 mm in diameter of a dynamic analyzer ("RDA-II", available from Rheometrics Co.) and subjected to application of a sinusoidal oscillation for measurement of G' and G". The measurement is performed at 150° C. and the frequency is 1 Hz. The measurement of G' and G" is sequentially performed at strains in the range of 1%–100%. The percentage changes $\gamma_{G'}$, and $\gamma_{G''}$ are calculated by the following formulae:

$$\gamma_{G'} = [(G'_{1\%} - G'_{50\%})/G'_{1\%}] \times 100 = [1 - (G'_{50\%}/G'_{1\%}): \times 100$$

$$\gamma_{G''} = [(G''_{1\%} - G''_{50\%})/G''_{1\%}] \times 100 = [1 - (G''_{50\%}/G''_{1\%})] \times 100$$

(2) Glass transition temperature Tq

Measurement may be performed in the following manner by using a differential scanning calorimeter ("DSC-7", available from Perkin-Elmer Corp.).

A sample in an amount of 5–20 mg, preferably about 10 mg, is accurately weighed.

The sample is placed on an aluminum pan and subjected to measurement in a temperature range of 30°–200° C. at a temperature-raising rate of 10° C./min in a normal temperature—normal humidity environment in parallel with a black aluminum pan as a reference.

In the course of temperature increase, a main absorption peak appears in the temperature region of 40°–100° C.

In this instance the glass transition temperature is determined as a temperature of an intersection between a DSC curve and an intermediate line passing between the base lines obtained before and after the appearance of the absorption peak (3) Molecular weight distribution The molecular weight (distribution) of a binder resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 μl of a GPC sample solution adjusted at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector.

For accurate measurement, it is appropriate to constitute the column as a combination of several commercially available polystyrene gel columns in order to effect accurate measurement in the molecular weight range of $10^3$–$2\times10^6$. A preferred example thereof may be a combination of μ-styragel 500, $10^3$, $10^4$ and $10^5$ available from Waters Co.; a combination of Shodex KF-801, 802, 803, 804 and 805 available from Showa Denko K.K.; or a combinations of TSK gel G1000H, G2000H, G2500H, G3000H, G4000H, G5000H, G6000H, G7000H, and GMH available from Toso K.K.

(4) THF-insoluble content (gel content)

The resinous residue (gel content) of a sample may be measured by Soxhlet's extraction in the following manner. About 0.5 g of a sample is weighed and placed in a cylindrical filter paper (e.g., "No. 86R" having a size of 28 mm×100 mm, available from Toyo Roshi K.K.) on a Soxhlet's extractor and subjected to 6 hours of extraction with 200 ml of THF. At this time, the reflux rate is controlled so that each THF extraction cycle takes ca. 4–5 minutes. After the extraction, the cylindrical filter paper is taken out and sufficiently dried to weigh the extraction residue. The gel content is calculated as $(W_2/W_1)\times100$ (wt. %), wherein $W_1$ denotes the sample resin weight and $W_2$ denotes the resin weight in the extraction residue. For example, the weight $W_1$ g refers to a sample toner weight minus the weight of a non-resinous THF insoluble matter such as a magnetic material and a pigment for a magnetic toner, or a sample toner weight minus the weight of a non-resinous THF-insoluble matter such as a pigment for a non-magnetic toner. Based on the weight $W_1$ g and the weight $W_2$ g obtained as the extraction residue weight minus the weight of a non-resinous THF-insoluble matter of the magnetic material and/or the pigment, the THF-insoluble resin content (gel) content is calculated as $(W_2/W_1)\times100\%$.

Referring to the sole figure, in operation, THF 14 contained in a vessel 15 is vaporized under heating by a heater 22, and the vaporized THF is caused to pass through a pipe 21 and guided to a cooler 18 which is always cooled with cooling water 19. The THF cooled in the cooler 18 is liquefied and stored in a reservoir part containing a cylindrical filter paper 16. Then, when the level of THF exceeds that in a middle pipe 17, the THF is discharged from the reservoir 17, the THF is discharged from the reservoir part to the vessel 15 through the pipe 17. During the operation, the toner or resin in the cylindrical filter paper is subjected to extraction with the thus circulating THF.

Hereinbelow, the present invention will be described with reference to Production Examples and Examples for evaluation of image forming performances.

Resin Production Example 1

| | |
|---|---|
| Terephthalic acid | 18 mol. % |
| n-Dodecenylsuccinic anhydride | 25 mol. % |

-continued

| | |
|---|---|
| Trimellitic anhydride | 5 mol. % |
| Bisphenol derivative of the above-described formula (A) (R = propylene, x + y = 2.2) | 52 mol. % |

The above ingredients were subjected to polycondensation to obtain a polyester (called "Polyester Resin A") having Mn=3,000, Mw=15,000, Tg=55° C., acid value=35 and THF-insoluble content=0%.

| | |
|---|---|
| Terephthalic acid | 23 mol. % |
| n-Dodecenylsuccinic anhydride | 23 mol. % |
| Trimellitic anhydride | 2 mol. % |
| Bisphenol derivatives of the above-described formula (A) (R = propylene, x + y = 2.2) | 52 mol. % |

The above ingredients were subjected to polycondensation to obtain a polyester (called "Polyester Resin B") having Mn=6,000, Mw=45,000, Tg=62° C., acid value=25 and THF-insoluble content=0%.

| | |
|---|---|
| Polyester Resin A | 100 wt. parts |
| Polyester Resin B | 100 wt. parts |
| Trimellitic anhydride | 8 wt. parts |

These ingredients were subjected to polycondensation to obtain a polyester (called "Polyester Resin I") having Mn=4,000, Mw=29,000, Tg=58° C., and value=30, THF-insoluble content=35%.

Resin Production Example 2

100 wt. parts of Polyester Resin A and 5 wt. pats of trimellitic anhydride were subjected to polycondensation to obtain a-polyester (called "Polyester Resin II") having Mn=4500, Mw=32,000, Tg=56° C., acid value=28 and THF-insoluble content=20%.

Resin Production Example 3

A prepolymer was prepared by reacting 1 mol of trimellitic anhydride with 3 mol of a bisphenol derivative of the above-described formula (A) (R=ethylene, x+y=2.2). Then, 10 wt. parts of the prepolymer was mixed with 100 wt. parts of Polyester Resin A and the mixture was subjected to further polycondensation to obtain a polyester (called "Polyester Resin III") having Mn=4,000, Mw=38,000, Tg=56° C., acid value=26, and THF-insoluble content=28%.

Resin Production Example 4

| | |
|---|---|
| Terephthalic acid | 24 mol. % |
| n-Dodecenylsuccinic anhydride | 24 mol. % |
| Bisphenol derivative of the above-described formula (B) (R = propylene, x + y = 2.2) | 52 mol. % |

The above ingredients were subjected to polycondensation to obtain a polyester ("Polyester Resin C") having Mn=3,500, Mw=18,000, Tg=56° C., acid value=30, and THF-insoluble content=0%.

Then, 5 mol % of trimellitic anhydride was further added to Polyester Resin C and subjected to polycondensation to obtain a polyester ("Polyester Resin IV") having Mn=5,800, Mw=45,000, Tg=60° C., acid value=22 and THF-insoluble content=45%.

Resin Production Example 5

| | |
|---|---|
| Styrene | 85 wt. parts |
| n-Butyl acrylate | 15 wt. parts |
| Di-tert-butyl peroxide | 2.5 wt. parts |
| Toluene | 500 wt. parts |

The above mixture was subjected to polymerization to obtain a styrene copolymer resin (called "Vinyl Resin (a)") having Mn=5,500, Mw=13,000 and Tg=60° C.

| | |
|---|---|
| Vinyl resin (a) | 100 wt. parts |
| Styrene | 75 wt. parts |
| n-Butyl acrylate | 20 wt. parts |
| Polyethylene glycol diacrylate (crosslinking agent: $CH_2{=}CHCOO(C_2H_4O)_nCOCH{=}CH_2$, n = 14, Mw = 742) | 5 wt. parts |
| Benzoyl peroxide | 3 wt. parts |

The above mixture was dispersed in an aqueous medium formed by dissolving (1 wt. part of polyvinyl alcohol in 1000 wt. parts of water and subjected to suspension polymerization, followed by washing with an NaOH aqueous solution to remove the polyvinyl alcohol to obtain a styrene copolymer-based resin composition (called "Vinyl Resin V") having Mn=8,000, Mw=60,000 and Tg=59° C.

Resin Production Example 6

Resin Production Example 5 was repeated except for replacing the polyethylene glycol diacrylate with 4 wt. parts of tetraethylene glycol dimethacrylate (Mw=330) to obtain a resin composition (called "Vinyl Resin VI") having Mn=7,500, Mw=72,000 and Tg=60° C.

Resin Production Example 7 (comparative)

| | |
|---|---|
| Terephthalic acid | 15 mol. % |
| n-Dodecenylsuccinic anhydride | 12 mol. % |
| Trimellitic anhydride | 25 mol. % |
| Bisphenol derivatives of the formula (A) | |
| (R = propylene, x + y = 2.2) | 20 mol. % |
| (R = ethylene, x + y = 2.2) | 28 mol. % |

The above ingredients were subjected to polycondensation to obtain a polyester (called "Polyester Resin VII" (comparative)) having Mn=4,000, Mw=35,000, Tg=60° C., and THF-insoluble content=40%.

Resin Production Example 8 (comparative)

| | |
|---|---|
| Terephthalic acid | 10 mol. % |
| n-Dodecenylsuccinic anhydride | 17 mol. % |
| Trimellitic anhydride | 25 mol. % |
| Bisphenol derivatives of the formula (A) | |
| (R = propylene, x + y = 2.2) | 15 mol. % |
| (R = ethylene, x + y = 2.2) | 33 mol. % |

The above ingredients were subjected to poly-condensation to obtain a polyester (called "Polyester Resin VIII" (comparative)) having Mn=8,000, Mw=91,000, Tg=63° C., and THF-insoluble content=45%.

Resin Production Example 9 (comparative)

Resin Production Example 5 was repeated except for replacing the polyethylene glycol diacrylate with 4 wt. parts of triethylene glycol dimethacrylate (Mw=286) to obtain a resin composition (called "Vinyl Resin IX" (comparative)) having Mn=7,000, Mw=70,000 and Tg=58° C.

Resin Production Example 10 (comparative)

Resin Production Example 5 was repeated except for replacing the polyethylene glycol diacrylate with 2 wt. parts of divinylbenzene to obtain a resin composition (called "Vinyl Resin X" (comparative)) having Mn=6,000, Mw=80,000 and Tg=60° C.

EXAMPLE 1

| | |
|---|---|
| Polyester Resin I | 100 wt. parts |
| Magnetic iron oxide (average particle size (Dav.) = 0.1 μm, Hc = 115 oersted, $\sigma_s$ = 80 emu/g, $\sigma_r$ = 11 emu/g) | 90 wt. parts |
| Long-chain alkyl alcohol of the above-described Formula (C) (x = 50) | 5 wt. parts |
| Mono-azo metal complex (negative charge control agent) | 2 wt. parts |

The above ingredients were pre-mixed by a Henschel mixer and melt-kneaded through a twin-screw extruder at 130° C. After cooling, the melt-kneaded product was coarsely crushed by a cutter mill and finely pulverized by a jet stream pulverizer, followed by classification by a pneumatic classifier to obtain a magnetic toner having a weight-average particle size of 6.5 μm. To 100 wt. parts of the magnetic toner, 1.0 wt. part of hydrophobic dry-process silica (BET specific surface area ($S_{BET}$)=300 $m^2/g$) was externally added to obtain a magnetic toner.

The thus-obtained magnetic toner was subjected to measurement of storage modulus G' and loss modulus G" at strains in the range of 1–50% in the above-described manner to obtain $G'_{1\%}=2.2\times10^4$ dyn/cm$^2$ and $G''_{1\%}=1.6\times10^4$ dyn/cm$^2$ at a strain of 1%, and $G'_{50\%}=2.1\times10^4$ dyn/cm$^2$ thus giving percentage changes of $\gamma_{G'}$=4.5% and $\gamma_{G''}$=6.3%.

The magnetic toner was charged and evaluated in a re-modeled machine of a commercially available laser beam printer ("LBP-A304", mfd. by Canon K.K.) under the conditions of a process speed of 50 mm/sec., a fixing roller diameter of 20 mm and a fixing pressure of ca. 1.3 kg/cm$^2$, and also in a re-modeled machine of a commercially available copier ("NP-8582", mfd. by Canon K.K.) under the conditions of a process speed of 500 mm/sec, a fixing roller diameter of 60 mm and a fixing pressure of ca. 5 kg/cm$^2$). The evaluation was performed with respect to, e.g., image qualities, fixability and anti-offset characteristic, whereby good results as shown in Tables 2 and 3 appearing hereinafter were obtained. Regarding the fixability, the fixing initiation temperature was lowered by 30°–40° C. than the conventional toner both in the low-speed system and in the high-speed system.

EXAMPLES 2–4

Magnetic toners were prepared and evaluated in the same manner as in Example 1 except that Polyester Resin I was replaced by Polyester Resins II–IV, respectively. The resultant magnetic toners showed viscoelastic properties as shown in Table 1 and good performances as shown in Tables 2 and 3.

EXAMPLES 5 and 6

Magnetic toners were prepared and evaluated in the same manner as in Example 1 except that Polyester Resin I was replaced by Vinyl Resins V and VI, respectively. The resultant magnetic toners showed viscoelastic properties as shown in Table 1 and good performances as shown in Tables 2 and 3. Regarding the fixability, the toners provided fixing initiation temperatures which were lower by 30°–40° C. in the low-speed system and lower by 10°–20° C. in the high-speed system, compared with those obtained by the conventional toners.

Comparative Examples 1–3

Magnetic toners were prepared and evaluated in the same manner as in Example 1 except that Polyester Resin I was replaced by Polyester Resin VII, Polyester Resin A and Polyester Resin VIII (all comparative). The resultant magnetic toners provided the results shown in Tables 1–3.

Comparative Examples 4 and 5

Magnetic toners were prepared and evaluated in the same manner as in Example 1 except that Polyester Resin I was replaced by Vinyl Resins IX and X (comparative). The resultant magnetic toners provided the results shown in Tables 1–3.

The toner performances shown in Tables 2 and 3 were evaluated in the manners described below and basically at 5 levels of excellent (o), good (oΔ), fair (Δ), rather inferior (Δx) and inferior (x).

Fixability

A sample image after image formation on 1000 sheets was rubbed with a lens cleaning paper to measure a density decrease before and after the rubbing. The image densities were measured by a refractive densitometer ("Macbeth RD918", mfd. by Macbeth Co.). A solid image having an image density of 1.1–1.5 and a halftone image having an image density of 0.4–0.7, respectively as measured before rubbing were evaluated.

The performances were evaluated by a density decrease and indicated as o (0–10%), oΔ (11–25%), Δ (26–35%), Δx (36–45%) and x (46% or above).

Fixing initiation temperature

The fixing initiation temperature was measured by effecting fixation of un-fixed solid black toner images at varying temperatures of the fixing device and to evaluate the lowest temperature at which the fixation was effected through confirmation by rubbing of the fixed images.

The results are shown in Tables 2 and 3 under the item of fixability for solid black images, e.g., 110° C. (Table 2) and 155° C. (Table 3) for Example 1.

Low-temperature offset

The fixability was evaluated in a low temperature/low humidity environment (10° C./15% RH).

High-temperature offset

The high-temperature offset temperature was measured as the lowest temperature at which the high-temperature occurred as a result of fixing tests at varying fixing device temperatures.

Web soiling

Soiling of the fixing roller cleaning web was evaluated after image formation and fixation on 1000 sheets each of a solid black image and a halftone image in a normal temperature/normal humidity environment (23° C./60% RH) and observing the soiling of the web by eyes.

Maximum image density (Dmax)

The maximum image density was evaluated according to the standards of o (≧1.35), oΔ (1.25–1.34), Δ (1.15–1.24), Δx (1.00–1.14) and x (<1.00).

White background fog

Fog was evaluated by measuring a worst or maximum reflection density (Ds %) on the white background after the image formation and an average reflection density (Dr %) of the white background on transfer paper before the image formation by using a reflective densitometer ("Reflectometer Model TC-6DS", mfd. by Tokyo Denshoku K.K.) and evaluated in terms of fog amount (=Ds–Dr %). The results are indicated as o (fog amount ≦1.5%), oΔ (1.6–2.0%), Δ (2.1–2.5%), Δx (2.6–3.5%) and x (≧3.6%).

Density gradation characteristic

Evaluated by eye observation.

Line scattering

Evaluated by eye observation,

Line collapsion (resolution failure)

Evaluated by eye observation.

Winding (offset).

Evaluated by passing solid black images to observe whether winding offset occurred or not.

Trace

Solid black images were formed to observe whether some traces of a separating member are left on the fixed images.

TABLE 1

| | | | Viscoelastic properties of toner | | | | | |
|---|---|---|---|---|---|---|---|---|
| Example | | Binder resin | $G'_{1\%}$ (dyn/cm$^2$) | $G''_{1\%}$ (dyn/cm$^2$) | $G'_{50\%}$ (dyn/cm$^2$) | $G''_{50\%}$ (dyn/cm$^2$) | $\gamma G'$ (%) | $\gamma G''$ (%) |
| Ex. | 1 | Polyester Resin I | $2.2 \times 10^4$ | $1.6 \times 10^4$ | $2.1 \times 10^4$ | $1.5 \times 10^4$ | 4.5 | 6.3 |
| | 2 | Polyester Resin II | $6.5 \times 10^3$ | $3.5 \times 10^3$ | $4.4 \times 10^3$ | $2.3 \times 10^3$ | 32.3 | 34.3 |
| | 3 | Polyester Resin III | $6.5 \times 10^4$ | $5.5 \times 10^4$ | $6.2 \times 10^4$ | $5.0 \times 10^4$ | 4.6 | 9.1 |
| | 4 | Polyester Resin IV | $7.0 \times 10^4$ | $6.0 \times 10^4$ | $5.5 \times 10^4$ | $4.6 \times 10^4$ | 21.4 | 23.3 |
| | 5 | Vinyl Resin V | $1.0 \times 10^4$ | $9.0 \times 10^3$ | $9.5 \times 10^3$ | $8.5 \times 10^3$ | 5.0 | 5.6 |
| | 6 | Vinyl Resin VI | $6.8 \times 10^4$ | $5.7 \times 10^4$ | $6.5 \times 10^4$ | $5.2 \times 10^4$ | 4.4 | 8.8 |
| Comp. | | | | | | | | |
| Ex. | 1 | Polyester Resin VII | $1.5 \times 10^4$ | $9.5 \times 10^3$ | $6.5 \times 10^3$ | $4.2 \times 10^3$ | 56.7 | 55.8 |
| | 2 | Polyester Resin A | $5.0 \times 10^3$ | $3.0 \times 10^3$ | $2.0 \times 10^3$ | $1.2 \times 10^3$ | 60.0 | 60.0 |
| | 3 | Polyester Resin VIII | $2.5 \times 10^5$ | $1.5 \times 10^5$ | $1.5 \times 10^5$ | $9.0 \times 10^4$ | 40.0 | 40.0 |
| | 4 | Vinyl Resin IX | $2.5 \times 10^4$ | $9.7 \times 10^3$ | $1.1 \times 10^4$ | $4.0 \times 10^3$ | 56 | 58.8 |
| | 5 | Vinyl Resin X | $4.1 \times 10^5$ | $2.5 \times 10^5$ | $2.0 \times 10^5$ | $1.2 \times 10^5$ | 51.2 | 52.0 |

TABLE 2

| | Fixability | | Low | High | Web soiling (Process speed = 50 mm/sec) | | | | Image characteristics | | | | |
|---|---|---|---|---|---|---|---|---|---|---|---|---|---|
| Example | Solid black | Half-tone | temp. offset | temp. offset | Solid black | Half-tone | Winding | Trace | Dmax. | Fog | Grada-tion | Line scatter | Line collapse |
| Ex. 1 | o | o | o | 240° C. | o | o | o | o | o | o | o | o | o |
| | 110° C. | | | | | | | | (1.40) | (1.2%) | | | |
| Ex. 2 | o | o | o | 210° C. | oΔ | oΔ | oΔ | oΔ | o | o | o | o | o |
| | 100° C. | | | | | | | | (1.40) | (1.3%) | | | |
| Ex. 3 | o | o | o | 240° C. | o | o | o | o | o | o | o | o | o |
| | 110° C. | | | | | | | | (1.40) | (1.2%) | | | |
| Ex. 4 | o | oΔ | o | 240° C. | o | oΔ | o | o | o | o | o | oΔ | oΔ |
| | 120° C. | | | | | | | | (1.40) | (1.3%) | | | |
| Ex. 5 | o | oΔ | oΔ | 230° C. | oΔ | oΔ | o | o | o | oΔ | o | o | o |
| | 130° C. | | | | | | | | (1.37) | (1.8%) | | | |
| Ex. 6 | o | oΔ | oΔ | 240° C. | oΔ | oΔ | o | o | o | oΔ | o | o | o |
| | 135° C. | | | | | | | | (1.36) | (1.8%) | | | |
| Comp. | Δ | Δx | Δ | 200° C. | Δ | Δx | Δx | Δx | Δ | Δ | Δ | Δ | Δ |
| Ex. 1 | 145° C. | | | | | | | | (1.20) | (2.3%) | | | |
| Comp. | Δ | Δ | oΔ | 190° C. | Δx | Δx | x | x | Δ | Δ | Δ | Δ | Δ |
| Ex. 2 | 140° C. | | | | | | | | (1.22) | (2.2%) | | | |
| Comp. | x | x | x | 200° C. | x | Δx | o | o | Δ | Δ | Δ | x | x |
| Ex. 3 | 150° C. | | | | | | | | (1.20) | (2.3%) | | | |
| Comp. | Δ | x | Δx | 200° C. | Δx | Δx | oΔ | oΔ | Δ | Δx | Δx | Δx | Δx |
| Ex. 4 | 160° C. | | | | | | | | (1.21) | (3.0%) | | | |
| Comp. | x | x | x | 200° C. | x | x | o | o | Δx | Δx | Δx | x | x |
| Ex. 5 | 170° C. | | | | | | | | (1.17) | (3.1%) | | | |

TABLE 3

| | Fixability | | Low | High | Web soiling (Process speed = 500 mm/sec) | | | | Image characteristics | | | | |
|---|---|---|---|---|---|---|---|---|---|---|---|---|---|
| Example | Solid black | Half-tone | temp. offset | temp. offset | Solid black | Half-tone | Winding | Trace | Dmax. | Fog | Grada-tion | Line scatter | Line collapse |
| Ex. 1 | o | o | o | 280° C. | o | o | o | o | o | o | o | o | o |
| | 155° C. | | | | | | | | (1.40) | (1.1%) | | | |
| Ex. 2 | o | o | o | 240° C. | o | o | oΔ | oΔ | o | o | o | o | o |
| | 145° C. | | | | | | | | (1.40) | (1.2%) | | | |
| Ex. 3 | o | o | o | 280° C. | o | o | o | o | o | o | o | o | o |
| | 155° C. | | | | | | | | (1.40) | (1.0%) | | | |
| Ex. 4 | oΔ | oΔ | oΔ | 280° C. | oΔ | oΔ | o | o | o | o | o | oΔ | oΔ |
| | 165° C. | | | | | | | | (1.40) | (1.2%) | | | |
| Ex. 5 | oΔ | oΔ | oΔ | 270° C. | oΔ | oΔ | o | o | o | oΔ | o | oΔ | oΔ |
| | 175° C. | | | | | | | | (1.38) | (1.7%) | | | |
| Ex. 6 | oΔ | oΔ | oΔ | 280° C. | oΔ | oΔ | o | o | o | oΔ | o | oΔ | oΔ |
| | 185° C. | | | | | | | | (1.38) | (1.8%) | | | |
| Comp. | Δ | x | x | 230° C. | x | x | Δ | x | Δ | Δ | Δ | x | x |
| Ex. 1 | 190° C. | | | | | | | | (1.22) | (2.4%) | | | |
| Comp. | x | x | x | 220° C. | x | x | x | x | Δ | Δ | Δ | x | x |
| Ex. 2 | 185° C. | | | | | | | | (1.21) | (2.3%) | | | |
| Comp. | x | x | x | 230° C. | x | Δx | Δ | Δ | Δ | Δ | Δ | x | x |
| Ex. 3 | 195° C. | | | | | | | | (1.20) | (2.2%) | | | |
| Comp. | Δ | x | x | 230° C. | x | x | Δx | x | Δ | Δx | Δx | Δx | Δx |
| Ex. 4 | 195° C. | | | | | | | | (1.22) | (2.8%) | | | |
| Comp. | x | x | x | 230° C. | x | x | o | o | Δx | Δx | Δx | x | x |
| Ex. 5 | 200° C. | | | | | | | | (1.08) | (3.0%) | | | |

What is claimed is:

1. A toner for developing an electrostatic image, comprising: a binder resin and a colorant; wherein the toner has a percentage change $\gamma_{G'}$ of at most 50% as calculated by the following formula (1):

$$\gamma_{G'}=(1-G'_{50\%}/G'_{1\%})\times 100 \quad (1),$$

wherein $\gamma_{G'}$ denotes a percentage change of storage modulus, $G'_{50\%}$ denotes a storage modulus at 50% strain at 150° C., and $G'_{1\%}$ denotes a storage modulus at 1% strain at 150° C., a percentage change $\gamma_{G''}$ of at most 50% as calculated by the following formula (2):

$$\gamma_{G''}=(1-G''_{50\%}/G''_{1\%})\times 100 \quad (2),$$

wherein $\gamma_{G''}$ denotes a percentage change of loss modulus, $G''_{50\%}$ denotes a loss modulus at 50% strain, and $G''_{1\%}$ denotes a loss modulus at 1% strain, and a storage modulus G' of $3\times10^3$–$7\times10^4$ dyn/cm$^2$ in a range of 1–50% strain at 150° C.

2. The toner according to claim 1, having a $\gamma_{G'}$ of 0.1–35% and a $\gamma_{G''}$ of 0.1–35%.

3. The toner according to claim 1, wherein said loss modulus G" is $2\times10^3$–$6\times10^4$ dyn/cm$^2$.

4. The toner according to claim 1, wherein the binder resin comprises a polyester resin, wherein the storage modulus G' is $4.5\times10^3$–$6.5\times10^4$ dyn/cm$^2$.

5. The toner according to claim 1, wherein the binder resin comprises a polyester resin, and said storage modulus G' is $4.5\times10^3$–$6.5\times10^4$ and said loss modulus G" is $3\times10^3$–$5.5\times10^4$ dyn/cm$^2$.

6. The toner according to claim 5, wherein the colorant comprises a powdery magnetic material present in amounts from 65–200 wt. parts per 100 wt. parts of the binder resin.

7. The toner according to claim 5, wherein the magnetic material is present in amounts from 70–150 wt. parts per 100 wt. parts of the binder resin.

8. The toner according to claim 1, wherein the binder resin comprises a vinyl resin, and the storage modulus G' is $5\times10^3$–$7\times10^4$ and said loss modulus G" is $5\times10^3$–$6\times10^4$ dyn/cm$^2$.

9. The toner according to claim 1, wherein the binder resin comprises a polyester resin; the polyester resin having a glass transition point of 40°–90° C., a number-average molecular weight of 1,000–50,000, and a weight-average molecular weight of 3,000–100,000.

10. The toner according to claim 9, wherein the polyester resin has a glass transition point of 45°–85° C., a number-average molecular weight of 1,500–20,000, and a weight-average molecular weight of 40,000–90,000.

11. The toner according to claim 1, wherein the binder resin comprises a vinyl resin; the vinyl resin having a glass transition point of 45°–80° C., a number-average molecular weight of 2,500–50,000, and a weight-average molecular weight of 10,000–1,000,000.

12. The toner according to claim 11, wherein the vinyl resin has a glass transition point of 55°–70° C.

13. The toner according to claim 11, wherein the colorant comprises a powdery magnetic material, which is contained in 65–200 wt. parts per 100 wt. parts of the binder resin.

14. The toner according to claim 13, wherein the magnetic material is contained in 70–150 wt. parts per 100 wt. parts of the binder resin.

15. The toner according to claim 1, wherein the colorant comprises a non-magnetic pigment or dye.

16. The toner according to claim 15, wherein the colorant is contained in 0.1–60 wt. parts per 100 wt. parts of the binder resin.

17. The toner according to claim 16, wherein the colorant is contained in 0.5–50 wt. parts per 100 wt. parts of the binder resin.

18. The toner according to claim 1, further comprising a release agent which is solid at room temperature.

19. The toner according to claim 18, wherein the release agent comprises a wax selected from the group consisting of aliphatic hydrocarbon waxes and oxidized products thereof, aliphatic acid ester waxes, saturated linear aliphatic acid, unsaturated aliphatic acids, saturated alcohols, polyhydric alcohols, saturated aliphatic acid amides, saturated aliphatic acid bisamides, unsaturated aliphatic acid amides, unsaturated aliphatic biamides, aromatic bisamides, aliphatic acid metal salts, grafted waxes, partially esterified products between aliphatic acid and polyhydric alcohol, and aliphatic acid methyl ester compounds.

20. The toner according to claim 18, wherein the release agent comprising an aliphatic alcohol wax or an aliphatic hydrocarbon wax.

21. The toner according to claim 18, wherein the release agent is contained in 0.1–20 wt. parts per 100 wt. parts of the binder resin.

22. The toner according to claim 21, wherein the release agent is contained in 0.5–10 wt. parts per 100 wt. parts of the binder resin.

23. The toner according to claim 1, having a weight-average particle size of 3–10 μm.

24. The toner according to claim 23, having a weight-average particle size of 3–9 μm.

25. The toner according to claim 1, wherein the binder resin is a polyester resin obtained by forming a linear polyester or a polyester having a low gel content and then adding an alcohol or acid having at least three functional groups to cause polycondensation.

26. The toner according to claim 1, wherein the binder resin is a polyester resin obtained by forming a polyester having a low gel content by employing an alcohol or acid having at least three functional groups and then adding at least one of (a) a linear or non-linear polyester or (b) an alcohol or an acid having at least three functional groups for further polycondensation.

27. The toner according to claim 1, wherein the binder resin comprises a crosslinked vinyl resin with a crosslinking agent having a molecular weight of at least 300.

* * * * *

UNITED STATES PATENT AND TRADEMARK OFFICE

CERTIFICATE OF CORRECTION

PATENT NO. : 5,578,408

DATED : November 26, 1996

INVENTOR(S) : TAKAAKI KOHTAKI ET AL.

It is certified that error appears in the above-identified patent and that said Letters Patent is hereby corrected as shown below:

COLUMN 5

Line 40, "comprise" should read --comprises--.

COLUMN 6

Line 51, "benzoate" should read --benzoate;--.
Line 60, "acrylate," (last occurrence) should read --acrylate;--.

COLUMN 7

Line 16, "acid" (1st occurrence) should read --acid,--.
Line 20, "acid" (1st and 2nd occurrences) should read --acid,--.
Line 28, "resin" (last occurrence) should read --resin,--.
Line 34, "preferred to" should be deleted.
Line 49, "providing" should read --provide--.

COLUMN 9

Line 52, "group" should read --group;--.

COLUMN 11

Line 2, "($\pi$r)" should read --($\sigma$r)--.
Line 44, "BLue" should read --Blue--.

COLUMN 12

Line 36, "desired" should read --desired,--.
Line 37, "within," should read --within--.
Line 65, "acid" should read --acid;--.

UNITED STATES PATENT AND TRADEMARK OFFICE

CERTIFICATE OF CORRECTION

PATENT NO. : 5,578,408

DATED : November 26, 1996

INVENTOR(S) : TAKAAKI KOHTAKI ET AL.

It is certified that error appears in the above-identified patent and that said Letters Patent is hereby corrected as shown below:

COLUMN 14

Line 19, "powder" should read --powders--.
Line 54, "Example" should read --Examples--.

COLUMN 18

Line 54, "instance" should read --instance,--.
Line 58, "peak" should read --peak.--.

COLUMN 19

Line 20, "combinations" should read --combination--.
Line 56, "reservoir 17, the THF is discharged from the reservoir part" should read --reservoir 20--.

COLUMN 20

Line 34, "pats" should read --parts--.
Line 36, "a-polyester" should read --a polyester--.

COLUMN 21

Line 21, "(1" should read --1--.

COLUMN 22

Line 46, "lowered" should read --lower--.

UNITED STATES PATENT AND TRADEMARK OFFICE

CERTIFICATE OF CORRECTION

PATENT NO. : 5,578,408

DATED : November 26, 1996

INVENTOR(S) : TAKAAKI KOHTAKI ET AL.

It is certified that error appears in the above-identified patent and that said Letters Patent is hereby corrected as shown below:

COLUMN 25

Line 25, "25" should be deleted.

Signed and Sealed this

Thirteenth Day of May, 1997

Bruce Lehman

*Attest:*

BRUCE LEHMAN

*Attesting Officer*

*Commissioner of Patents and Trademarks*